US005421036A

United States Patent [19]

Stevens et al.

[11] Patent Number: 5,421,036

[45] Date of Patent: Jun. 6, 1995

[54] WATER CLOSET INSTALLATION SYSTEM

[76] Inventors: John Stevens, 6125 Chicago Rd., Warren, Mich. 48092; Gene Michael, 18993 Brentwood, Livonia, Mich. 48152

[21] Appl. No.: 946,041

[22] Filed: Sep. 15, 1992

Related U.S. Application Data

[63] Continuation of Ser. No. 696,061, May 6, 1991, abandoned.

[51] Int. Cl.[6] ..... E03D 11/00

[52] U.S. Cl. ..... 4/252.1; 285/60

[58] Field of Search ..... 4/252.1–252.6; 411/383, 384, 386, 388, 389, 396, 397, 398, 400, 401, 107; 285/56–60

[56] References Cited

U.S. PATENT DOCUMENTS

| | | | |
|---|---|---|---|
| 952,602 | 3/1910 | Candee . | |
| 1,507,488 | 5/1922 | Kraemer | 411/107 X |
| 1,545,839 | 7/1925 | Mason | 4/252.3 |
| 1,548,850 | 8/1925 | Rudolph . | |
| 2,781,073 | 2/1957 | Trafton | 411/107 |
| 3,180,660 | 4/1965 | Brewington | 285/60 |
| 3,181,585 | 5/1965 | Brewington | 285/60 |
| 3,419,298 | 10/1966 | Worley | 4/252 R |
| 3,905,052 | 9/1975 | DeAngelis | 4/252 R |
| 4,227,722 | 10/1980 | Barber | 285/56 |
| 4,530,629 | 7/1985 | Sakow | 411/147 |
| 4,850,063 | 7/1989 | Abbate | 4/252 R |
| 4,907,301 | 3/1990 | Tucker | 4/252.5 |
| 4,907,923 | 3/1990 | McGrath, Jr. | 411/107 |

FOREIGN PATENT DOCUMENTS

| | | | |
|---|---|---|---|
| 0621549 | 9/1962 | Belgium | 4/252.1 |

OTHER PUBLICATIONS

Jones Manufacturing Co. Catalog, Jan. 15, 1991 pp. 1A–5.

*Primary Examiner*—Charles E. Phillips

*Attorney, Agent, or Firm*—Gifford, Krass, Groh, Sprinkle, Patmore, Anderson & Citkowski

[57] ABSTRACT

A variable length bolt is employed in connection with a floor flange for the mounting of plumbing fixtures. The bolt decreases in length when tightened thereby eliminating the need to trim off excess lengths of projecting bolt or to provide an opening in the subjacent floor to accommodate excess bolt length.

6 Claims, 2 Drawing Sheets

FIG-1
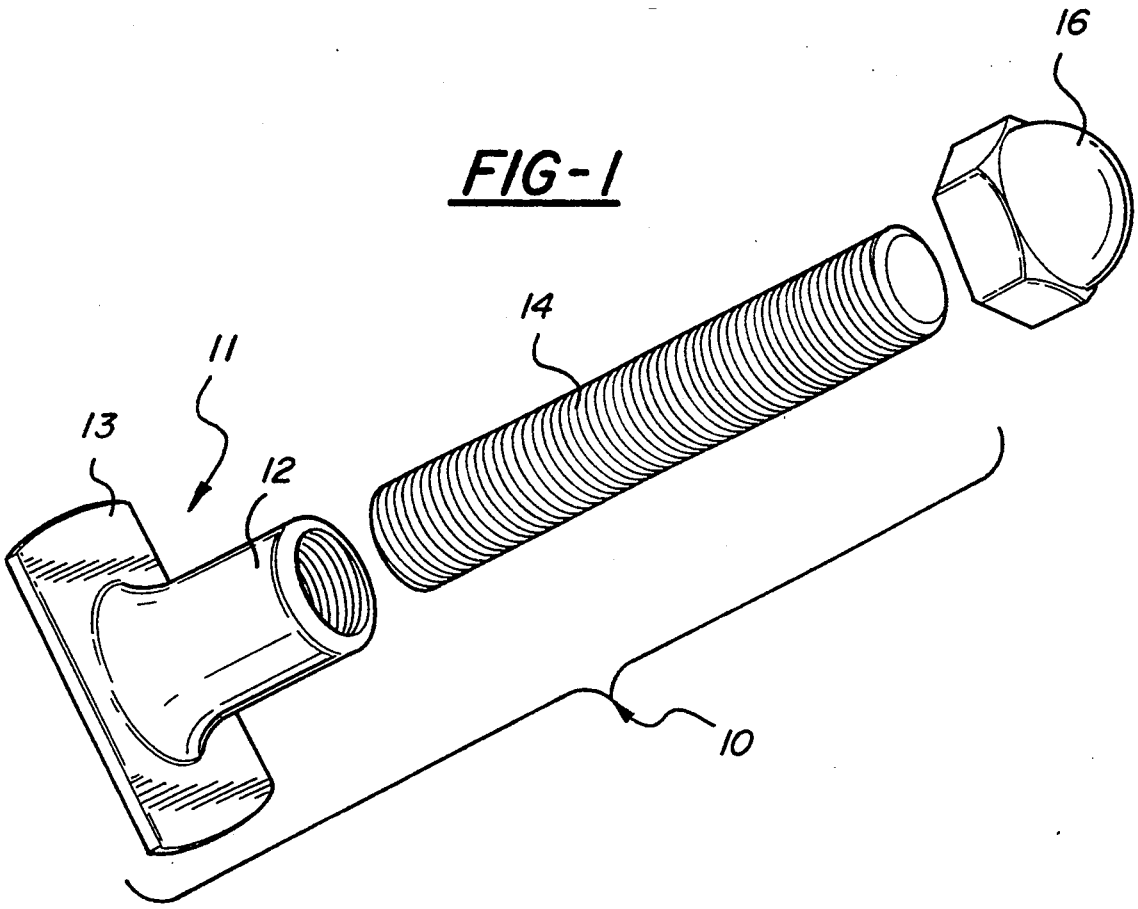
FIG-2A
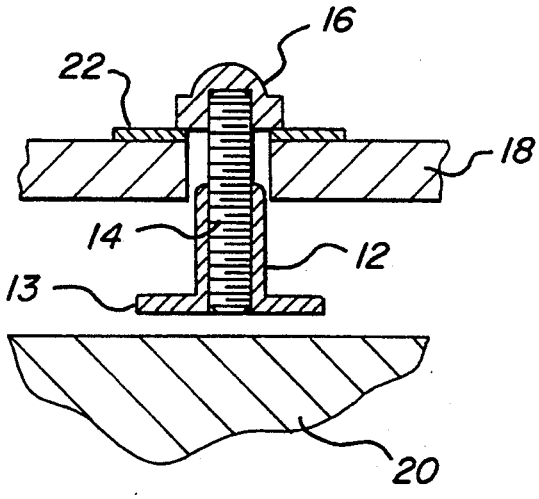
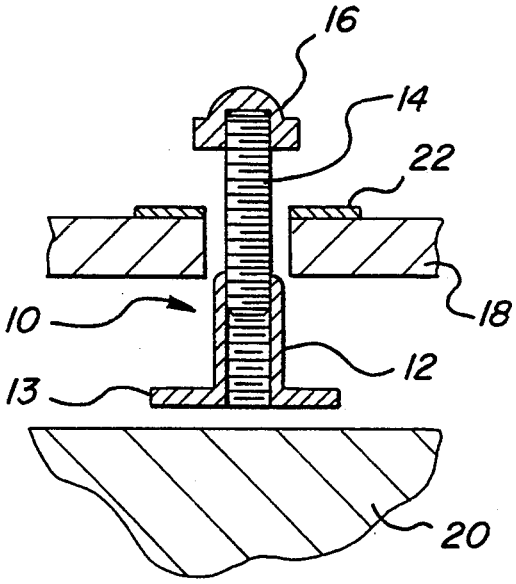
FIG-2B

WATER CLOSET INSTALLATION SYSTEM

This is a continuation of application Ser. No. 696,061 filed on May 6, 1991 now abandoned.

FIELD OF THE INVENTION

This invention relates generally to the installation of plumbing fixtures. More particularly, the invention relates to the installation of flange mounted plumbing fixtures. Most specifically, the present invention relates to a variable length closet bolt.

BACKGROUND OF THE INVENTION

Toilets, urinals, bidets and the like are affixed, in communication with a drain line, to floors, walls or other portions of a structure through the use of a mounting flange. The flange is first affixed in registry with the drain line through the use of nails, screws or similar fasteners. The plumbing fixture is then mounted on the flange and the discharge outlet thereof is sealingly engaged to the flange by a wax ring or other such water-tight, flexible gasket. The fixture and flange are then rigidly bolted together.

In a typical installation, the mounting bolts are first fitted into slots in the flange where they are retained by their head portions so that the threaded portion of the bolt projects from the flange perpendicular to the floor. The plumbing fixture includes a series of holes in the base thereof spaced to engage with the projecting portions of the bolts. Nuts and washers are then used to secure the fixture to the bolts. In a final step, the projecting portion of the bolts is covered with a decorative cap.

Frequently, the projecting portion of the bolt is too long to be covered by the cap. This is because the bolts are typically made extra long to accommodate the uncertain geometries of the floor, and the size variations in flanges and particular plumbing fixtures. In such instance, the plumber making the installation must use a bolt cutter or hack saw to shorten the bolt shaft sufficiently to enable the decorative cover to be attached. This process entails several problems. First of all, it is fairly difficult to cut the bolt after the fixture has been installed since clearance between the bolt and the base of the fixture is frequently tight; and often, clearance within the bathroom where the fixture is installed is minimal. As a result, shortening of the bolt is difficult and time consuming and frequently causes accidental damage to the finish of the plumbing fixture itself. In response to this problem, bolts with scored portions to facilitate the snapping off of segments thereof are frequently employed. Use of these bolts still entails mechanical operations in close quarters and can result in damage to the finish of the plumbing fixture. Additionally, the snap-off segments may not be adequately configured to permit appropriate shortening of the bolt segments.

Another solution to the problem is presented in U.S. Pat. No. 3,905,052. As shown therein, a plumbing fixture may be mounted to a floor flange through the use of a threaded rod and a pair of nuts. The first nut is a conventional flat nut and it is retained beneath the flange in registry with the slot. The second nut is a cap nut and it is disposed on one end of the threaded rod. The rod is inserted through the slot and engages the flat nut therebeneath. Tightening of the cap nut draws the flange and fixture together and the extra length of the threaded rod passes through a prepared opening in the floor. While the system disclosed in the '052 patent does function for some installation, the requirement of forming particular and extra openings in the floor limits its use significantly. When the plumbing fixtures are being installed in new buildings having wood floors, it is relatively simple to provide the necessary holes; however, when installation is being made on concrete floors or when replacement work is being undertaken in existing structures, it is difficult, or impossible, to provide the necessary clearance openings. Another problem dependent upon the design of the '052 fastener is that the bolt-flat nut assembly will fall through the opening during installation steps if an additional elastomeric retainer member is not employed.

Yet another approach to the problem has been developed by the Jones Manufacturing Company, Inc., of Birmingham, Ala. Their 1991 catalogue, at page 1A-5, depicts an adjustable closet bolt. The bolt shown in the Jones catalogue includes a threaded rod having a screw slot at one end thereof and used in conjunction with a plastic retainer which is configured to be supported by the flange. The retainer includes a closed passage therethrough which engages the rod. The assembly also includes an open ended wing nut. In use, the retainer is engaged to the flange, the rod is screwed into the retainer and the fixture placed on the flange. The length of the projecting portion of the bolt is then adjusted by screwing the rod into the retainer through the use of the screw slot. The wing nut is then tightened to retain the plumbing fixture. This mounting bolt involves separate shortening and nut tightening steps, and requires the use of a screwdriver in the confined environment of the plumbing fixture. Additionally, the closed base limits the range of adjustability. Accordingly, there is still a need for a simple to use adjustable, closet bolt assembly.

In view of the foregoing, it will be appreciated that there is a need for bolts for the installation of flange mounted plumbing fixtures, which eliminate the need for sawing, breaking or otherwise shortening the bolts after installation. It is furthermore desirable that any such bolts not require any extra holes to be made in the flooring or that their installation requires the use of screwdrivers and the like in close confines. For ease of installation it is also desirable to have the bolts be self-retaining and not be prone to slip through or beneath the flange. Obviously, it is most important that any such bolt be simple to use and completely compatible with standard mounting hardware presently employed.

As will be described in greater detail hereinbelow, the present invention is directed to apparatus and method for affixing a variety of plumbing fixtures to floor or wall flanges. The present invention includes a variable length closet bolt which easily and simply replaces presently employed closet bolts but which allows for a large range of continuous adjustment of its length. The present invention is simple to use, economical to manufacture and greatly simplifies installation of plumbing fixtures. These and other advantages of the present invention will be readily apparent from the drawings, discussion and description which follow.

BRIEF DESCRIPTION OF THE INVENTION

There is disclosed herein a variable length closet bolt for use in plumbing installations of the type which comprise a plumbing fixture having an aperture for receiving a mounting bolt therethrough, and a mounting flange configured to be affixed to the subjacent structure and including an opening to receive the mounting bolt therein and further including means associated with the opening for retaining the mounting bolt. The variable length bolt of the present invention includes in combination: a threaded rod member; a T-nut having a generally planar head portion configured to fit into the opening in the flange and to be retained by the retaining means thereof. The head portion includes an aperture sufficiently large to permit the rod to pass therethrough. The T-nut further includes a sleeve portion disposed perpendicular to the head portion and comprising a hollow cylinder defining a passage therethrough having internal threads configured to engage a portion of the threaded rod and aligned with the aperture in the head portion. The variable length bolt further includes a cap nut disposed on one end of the rod. In use, the length of the variable bolt may be adjusted by varying the length of the portion of the threaded rod engaged by the internal threads of the hollow cylinder. This adjustment is accomplished concomitant with the tightening of the cap nut.

In further embodiments, the T-nut has a thickness which is generally less than the length of the sleeve portion thereof. In particular embodiments, the T-nut has a generally oblong head having a length greater than its width. The sleeve portion of the T-nut may have a length sufficient to allow it to project from the flange when retained therein.

The present invention is also directed to a method for mounting a plumbing fixture onto a flange through the use of the variable length closet bolt disclosed herein.

BRIEF DESCRIPTION OF THE DRAWINGS

FIG. 1 is an exploded perspective view of one embodiment of variable length closet bolt structured in accord with the present invention;

FIG. 2A is a cross-sectional view of the variable length bolt of the present invention in use for engaging a portion of a plumbing fixture, said bolt having the rod member thereof only partially engaged with the sleeve member;

FIG. 2B is a cross-sectional view generally similar to that of FIG. 2A but showing the bolt engaged with the fixture and having the rod member thereof fully engaged with the sleeve portion thereof;

DETAILED DESCRIPTION OF THE INVENTION

Figure 3:
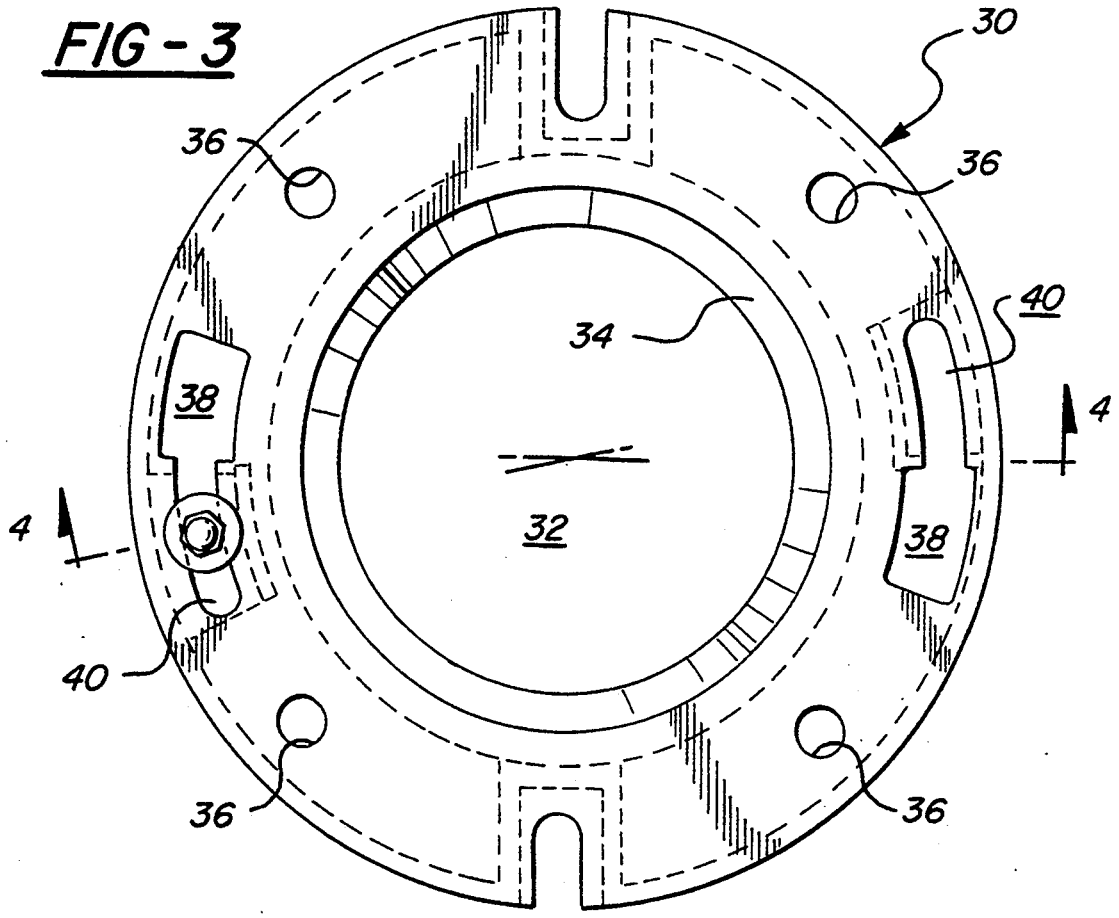
FIG. 3 is a top plan view of a conventional floor flange.

Referring now to FIG. 1 there is shown an exploded, perspective view of a variable length bolt 10. This bolt 10 may be used in accord with the principles of the present invention for the installation of flange mounted plumbing fixtures. Use of the bolt 10 greatly simplifies mounting of the fixtures as will be explained in greater detail hereinbelow. The bolt 10 includes a T-nut 11 which comprises a generally planar head portion 13 having a sleeve portion 12 projecting perpendicularly therefrom. The head portion is configured to fit into, and be retained by the flange as will be explained in greater detail hereinbelow, and toward this end, in the illustrated embodiment, the head portion 13 comprises a generally elongated member having a length greater than its width. The sleeve portion 12 is generally formed integral with the head portion 13 and is configured as a hollow cylinder having internal threading.

The variable length bolt 10 further includes a threaded rod member 14 and the threads on the rod 14 are configured to engage the threading in the sleeve member 12. The variable length bolt assembly 10 also includes a cap nut 16. As is well known in the trade, cap nuts include one closed end and do not permit passage of a bolt entirely therethrough. Cap nut are also referred to in the trade as "acorn nuts" or "blind nuts." The variable length bolt 10 of the present invention may be fabricated from a variety of materials having sufficient durability to enable them to retain the plumbing fixture and flange in a tightly associated relationship. Toward this end, it is generally preferred that the components be fabricated from metals and they most typically are of brass, steel, bronze and the like.

Referring now to FIGS. 2A and 2B there is illustrated the operation of the variable length bolt of the present invention for installation of a plumbing fixture. FIG. 2A depicts the variable length bolt 10 in cross-section as disposed to pass through an aperture in a plumbing fixture 18, or the like shown here in partial cross-section. As further illustrated, the head portion 13 is shown proximate a portion of a floor 20 or other such subjacent surface. It should be noted that in order to simplify the illustration, various other structures such as flanges and the like will be eliminated from this drawing although they are described in further detail in conjunction with FIGS. 3 and 4 herein below. In the FIG. 2A embodiment, the bolt 10 is shown in its extended form and toward that end it will be noted that the threaded rod portion 14 of the bolt 10 is engaged with only a small portion of the length of the sleeve portion 12. The threaded rod 14 passes through the aperture in the plumbing fixture 18 and also through a washer 22 disposed thereatop. The cap nut 16 is placed on the threaded rod 14 and when tightened serves to further engage the rod portion with the sleeve portion 12. Referring now to FIG. 2B, there is shown the same assembly of FIG. 2A in a more fully engaged configuration. As illustrated, the rod portion 14 has been advanced to fully engage the sleeve portion 12 thereby drawing the cap nut 16 onto the washer 22 thereby securing the fixture 18. It is to be understood that in actual use, a flange is affixed to the subjacent surface 20 and cooperates with the head portion 13 to prevent upward movement thereby rigidly attaching the plumbing fixture 18 to the subjacent surface 20. It is also to be understood that while the threaded rod 14 is shown as completely filling the cylindrical sleeve portion 12, depending upon the particular installation employed, it may be necessary to only partly fill the sleeve portion 12 in order to attach the plumbing fixture or, in some instances, the rod 14 may project from the base 13 of the T-nut portion through an opening in the head portion communicating with the sleeve portion.

It will be appreciated from the illustration of FIGS. 2A and 2B that the variable length bolt of the present invention allows for a large range of continuous length adjustment and as such is differentiated from the prior art closet bolts which have snap-off portions at preselected locations. The present invention is further differentiated from the flat nut arrangement used in the '052 patent, since the sleeve portion and threaded rod cooperate to actually shorten the length of the resultant bolt during tightening thereby eliminating the need for making a clearance hole in the subjacent floor. The present invention is also differentiated from the Jones bolt kit since shortening of the bolt is accomplished concomitant with the tightening of the cap nut thereby eliminating a separate step.

Referring now to FIG. 3, there is shown a top plan view of a standard flange 30 of the type used to mount toilets and the like on floors. The flange includes a central opening 32 having a perpendicular sleeve depending therefrom which engages the sewer stack. The flange 30 further includes a beveled regions 34 surrounding the opening 32 for retention of a sealing gasket used in conjunction with the plumbing fixture. The flange 30 also includes mounting holes 36 used in conjunction with screws, lag bolts or the like to affix the flange firmly to a subjacent floor. The flange 30 includes openings 38 which are large enough to receive the head of a standard closet bolt. These openings are in communication with a slot 40 which is sufficiently narrow to retain the head of the closet bolt but sufficiently wide to permit the shaft thereof to pass therethrough.

Figure 4:
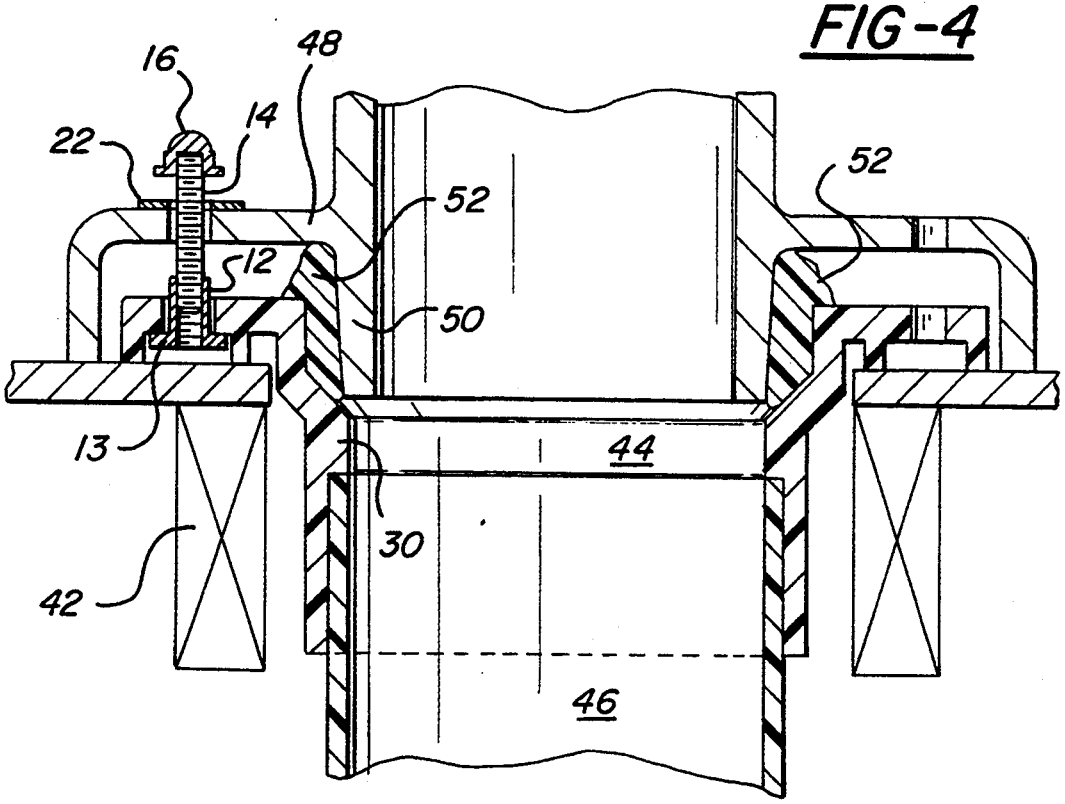
FIG. 4 is a cross-sectional view of a portion of a floor, a flange and a plumbing fixture as installed and in the process of being secured by the bolt of the present invention.

Referring now to FIG. 4 there is shown a cross-sectional view of a typical plumbing installation employing the present invention. The illustration depicts a cross section of a portion of a floor 42 having a flange 30 generally similar to that of FIG. 3 and taken along section line 4—4. The flange 30 is affixed to the floor 42 as previously described. Visible in this view is a projecting portion of the flange 44 which engages the sewer stack 46. Disposed atop the flange is a plumbing fixture, in this instance a toilet shown here in cross-section at reference numeral 48. The toilet includes a drain portion 50 which aligns with the downwardly projecting portion 44 of the flange 30. The toilet 48 is sealed to the flange by means of a wax gasket 52.

Disposed in, and retained by the slot of the flange is the variable length bolt of the present invention. Specifically, the head portion 13 of the bolt is retained by the flange 30 while the sleeve portion 12 passes through the slotted opening and, in this instance, projects somewhat therefrom. The threaded rod 14 of the variable length bolt is partially engaged with the sleeve portion. The toilet 48 includes a mounting aperture and when the toilet is placed onto the flange, this aperture is aligned with the slot in the flange and the projecting threaded rod 14 of the bolt. It is to be noted that the planar base 13 of the bolt assembly, and the fact that no clearance hole is required beneath the flange, allow the bolt to rest on the floor 42 thereby permitting the threaded rod 14 to project from the flange without need for any additional support. This feature allows for easy alignment of the mounting aperture in the toilet base 48 with the flange and bolt.

Once the toilet has been seated on the flange and adjusted for the proper orientation, the cap nut 16 is placed on the threaded rod 14 of the bolt and tightened. Tightening of the cap nut 16 causes the threaded rod 14 to advance through the sleeve 12. The head portion 13 of the bolt engages the flange 30 and is prevented from further upward motion. Continued tightening of the cap nut further shortens the variable length bolt and the cap nut ultimately comes to rest on the washer 22 thereby drawing the toilet 48 and flange 30 into a tightly mated relationship. At this point, the projecting cap nut 16 may be covered with a decorative cover. In some instances, the cap nut itself may be sufficiently decorative to preclude the need for any further cover.

It can thus be seen that the plumbing installation of the present invention provides a finished appearance free of any projecting length of bolt thereby precluding the need to cut or snap-off excess bolt length in order to accommodate a decorative cover. Furthermore, the installation of the present invention may be readily disassembled to permit removal of the plumbing fixture. The installation may be made without the need for drilling any holes and eliminates the need for any retainers to prevent the bolt from dropping beneath the flange during assembly steps.

While described primarily with regard to the mounting of toilets and the like on floor flanges, it is to be understood that the present invention may be readily adapted to mounting of a variety of plumbing, electrical and other types of fixtures. In view of the foregoing, it will be appreciated that the present invention may be practiced other than as shown and described herein. Numerous modifications and variations thereof are possible within the scope of the present invention. The foregoing drawings, discussion and description are merely meant to be illustrative of particular embodiments of the present invention and not limitations on the practice thereof. It is the following claims, including all equivalents, which define the scope of the invention.

We claim:

1. In a plumbing installation of the type comprising a mounting bolt, a plumbing fixture having at least one aperture for receiving the mounting bolt therethrough and a mounting flange configured to be affixed to a subjacent structure and including an opening configured to receive the mounting bolt therein and further including means associated with said opening for retaining the bolt therein, wherein the improvement comprises: said mounting bolt being a variable length bolt which includes in combination:

a threaded rod member;

a T-nut having a generally planar head portion having a length which is greater than a width thereof, said head portion configured to fit into the opening in the flange and to be retained by the retaining means, said head portion having an aperture therethrough sufficient to permit passage of the rod member, said T-nut further including a sleeve portion disposed perpendicular to the head portion, said sleeve portion comprising a hollow cylinder of a length greater than a thickness of said head portion, and having a diameter less than the length and less than the width of the head portion said sleeve portion defining a passage therethrough having internal threads configured to engage a portion of the threaded rod; said passage aligned with the aperture in the head portion so that the rod member can pass through the passage and the aperture, said T-nut disposed to have one end, and a portion of the length, of the rod member retained therein; and a cap nut having internal threads configured to engage the threaded rod, said nut disposed on a second end of the rod member, whereby, when said bolt is threaded through said fixture and said flange, tightening of the cap nut increases the length of the portion of the threaded rod engaged by the T-nut so as to decrease the length of the bolt concomitant with the tightening of the nut such that the cap nut bears tightly against a portion of said fixture and the head of the T-nut bears tightly against said flange.

2. A plumbing installation as in claim 1, wherein the head portion of the T-nut has a thickness which is less than the height of the cylindrical sleeve portion.

3. A plumbing installation as in claim 1, wherein the T-nut is manufactured from a metal.

4. A plumbing installation as in claim 1, wherein the sleeve portion of the T-nut has a height which allows it to project from the flange when the head of said T-nut is retained therein.

5. A plumbing installation as in claim 1, wherein the head portion of the T-nut has an opening therein aligned and communicating with the passage through said sleeve portion.

6. A plumbing installation as in claim 1, wherein said plumbing fixture is a toilet, said flange is configured to be affixed to a floor, the opening in the flange is configured to receive the head of the T-nut and the bolt retaining means comprises a slot communicating with the opening, said slot configured to pass the sleeve portion of the T-nut therethrough but to retain the head portion thereof.

* * * * *